US005939243A

United States Patent [19]

Eichorst et al.

[11] Patent Number: 5,939,243

[45] Date of Patent: Aug. 17, 1999

[54] IMAGING ELEMENT COMPRISING AN ELECTRICALLY-CONDUCTIVE LAYER CONTAINING MIXED ACICULAR AND GRANULAR METAL-CONTAINING PARTICLES AND A TRANSPARENT MAGNETIC RECORDING LAYER

[75] Inventors: Dennis J. Eichorst, Fairport; Paul A. Christian, Pittsford, both of N.Y.

[73] Assignee: Eastman Kodak Company, Rochester, N.Y.

[21] Appl. No.: 09/071,967

[22] Filed: May 4, 1998

[51] Int. Cl.[6] ..... G03C 1/85; G03C 1/89; G03C 8/52; G03C 5/10

[52] U.S. Cl. ..... 430/530; 430/63; 430/69; 430/140; 430/201; 430/527

[58] Field of Search ..... 430/527, 530, 430/140, 201, 63, 69

[56] References Cited

U.S. PATENT DOCUMENTS

| | | | |
|---|---|---|---|
| 3,782,947 | 1/1974 | Krall . | |
| 4,203,769 | 5/1980 | Guestaux . | |
| 4,279,945 | 7/1981 | Audran et al. | 430/271 |
| 4,302,523 | 11/1981 | Audran et al. | 430/140 |
| 4,999,276 | 3/1991 | Kuwabara et al. | 430/264 |
| 5,006,451 | 4/1991 | Anderson et al. | 430/530 |
| 5,116,666 | 5/1992 | Konno | 428/220 |
| 5,122,445 | 6/1992 | Ishigaki | 430/530 |
| 5,147,768 | 9/1992 | Sakakibara | 430/501 |
| 5,202,179 | 4/1993 | Kasahara | 428/323 |
| 5,217,804 | 6/1993 | James et al. | 428/329 |
| 5,229,259 | 7/1993 | Yokota | 430/523 |
| 5,284,714 | 2/1994 | Anderson et al. | 428/454.5 |
| 5,294,525 | 3/1994 | Yamauchi et al. | 430/530 |
| 5,336,589 | 8/1994 | Mukunoki et al. | 430/501 |
| 5,360,706 | 11/1994 | Anderson et al. | 430/530 |
| 5,366,855 | 11/1994 | Anderson et al. | 430/530 |
| 5,382,494 | 1/1995 | Kudo et al. | 430/140 |
| 5,395,743 | 3/1995 | Brick et al. | 430/501 |
| 5,413,900 | 5/1995 | Yokota | 430/501 |
| 5,427,835 | 6/1995 | Morrison et al. | 430/527 |
| 5,427,900 | 6/1995 | James et al. | 430/140 |
| 5,432,050 | 7/1995 | James et al. | 430/501 |
| 5,457,013 | 10/1995 | Christian et al. | 430/496 |
| 5,459,021 | 10/1995 | Ito et al. | 430/527 |
| 5,466,536 | 11/1995 | Berner et al. | 430/527 |
| 5,484,694 | 1/1996 | Lelental et al. | 430/530 |
| 5,498,512 | 3/1996 | James et al. | 430/140 |
| 5,514,528 | 5/1996 | Chen et al. | 430/530 |
| 5,582,959 | 12/1996 | Ito | 430/530 |
| 5,718,995 | 2/1998 | Eichorst et al. | 430/530 |
| 5,719,016 | 2/1998 | Christian et al. | 430/530 |
| 5,731,119 | 3/1998 | Eichorst et al. | 430/430 |

FOREIGN PATENT DOCUMENTS

| | | |
|---|---|---|
| 616252 | 1/1994 | European Pat. Off. . |
| 404091 | 8/1995 | European Pat. Off. . |
| 59-006235 | 1/1984 | Japan . |
| 63-060452 | 3/1988 | Japan . |
| 63-098656 | 4/1988 | Japan . |
| 63-287849 | 11/1988 | Japan . |
| 1-262537 | 10/1989 | Japan . |
| 2-307551 | 12/1990 | Japan . |
| 4-027937 | 1/1992 | Japan . |
| 4-029134 | 1/1992 | Japan . |
| 4-062543 | 2/1992 | Japan . |
| 4-097339 | 3/1992 | Japan . |
| 6-161033 | 6/1994 | Japan . |
| 7-168293 | 7/1995 | Japan . |
| 7-295146 | 11/1995 | Japan . |
| 91-05668 | 5/1991 | WIPO . |
| 94-25966 | 11/1994 | WIPO . |

*Primary Examiner*—Richard L. Schilling
*Attorney, Agent, or Firm*—Carl F. Ruoff

[57] ABSTRACT

The present invention is an imaging element which includes a support and at least one image-forming layer superposed on the support. The imaging element includes at least one transparent electrically-conductive layer and a transparent magnetic recording layer overlying the transparent electrically-conductive layer. The electrically conductive layer is composed of both electrically-conductive granular metal-containing colloidal particles having an average particle diameter of less than or equal to 0.05 $\mu$m and electrically-conductive acicular metal-containing particles having a cross-sectional diameter of less than or equal to 0.02 $\mu$m and an aspect ratio greater than or equal to 5:1 dispersed in a first film-forming binder. The transparent magnetic recording layer is composed of magnetic particles dispersed in a second film-forming binder.

15 Claims, No Drawings

IMAGING ELEMENT COMPRISING AN ELECTRICALLY-CONDUCTIVE LAYER CONTAINING MIXED ACICULAR AND GRANULAR METAL-CONTAINING PARTICLES AND A TRANSPARENT MAGNETIC RECORDING LAYER

FIELD OF THE INVENTION

This invention relates generally to imaging elements and in particular, to imaging elements including a support, at least one image-forming layer, at least one transparent, electrically-conductive layer, and a transparent magnetic recording layer. More specifically, this invention relates to photographic and thermally-processable imaging elements including one or more imaging layers and a transparent magnetic recording layer in combination with one or more electrically-conductive layers containing electrically-conductive acicular and granular metal-containing colloidal particles, both dispersed in one or more film-forming binders, which provide protection for such imaging elements against the accumulation and discharge of electrostatic charge or serve as transparent electrodes in an image-forming process.

BACKGROUND OF THE INVENTION

It is well known to include in various kinds of imaging elements, a transparent layer containing magnetic particles dispersed in a polymeric binder. The inclusion and use of such transparent magnetic recording layers in light-sensitive silver halide photographic elements has been described in U.S. Pat. Nos. 3,782,947; 4,279,945; 4,302,523; 5,217,804; 5,229,259; 5,395,743; 5,413,900; 5,427,900; 5,498,512; and others. Such elements are advantageous because images can be recorded by customary photographic processes while information can be recorded simultaneously into or read from the magnetic recording layer by techniques similar to those employed for traditional magnetic recording art.

A difficulty, however, arises in that magnetic recording layers generally employed by the magnetic recording industry are opaque, not only because of the nature of the magnetic particles, but also because of the requirements that these layers contain other addenda which further influence the optical properties of the layer. Also, the requirements for recording and reading of the magnetic signal from a transparent magnetic layer are more stringent than for conventional magnetic recording media because of the extremely low coverage of magnetic particles required to ensure transparency of the transparent magnetic layer as well as the fundamental nature of the photographic element itself. Further, the presence of the magnetic recording layer cannot interfere with the function of the photographic imaging element.

The transparent magnetic recording layer must be capable of accurate recording and playback of digitally encoded information repeatedly on demand by various devices such as a camera or a photofinishing or printing apparatus. The layer also must exhibit excellent runnability, durability (i.e., abrasion and scratch resistance), and magnetic head-cleaning properties without adversely affecting the image quality of the photographic elements. However, this goal is extremely difficult to achieve because of the nature and concentration of the magnetic particles required to provide sufficient signal to write and read magnetically stored data and the effect of any noticeable color, haze or grain associated with the magnetic layer on the optical density and granularity of the photographic layers. These goals are particularly difficult to achieve when magnetically recorded information is stored and read from the photographic image area. Further, because of the curl of the photographic element, primarily due to the photographic layers and the core set of the support, the magnetic layer must be held more tightly against the magnetic heads than in conventional magnetic recording in order to maintain planarity at the head-media interface during recording and playback operations. Thus, all of these various characteristics must be considered both independently and cumulatively in order to arrive at a commercially viable photographic element containing a transparent magnetic recording layer that will not have a detrimental effect on the photographic imaging performance and still withstand repeated and numerous read-write operations by a magnetic head.

Problems associated with the generation and discharge of electrostatic charge during the manufacture and use of photographic film and paper have been recognized for many years by the photographic industry. The accumulation of charge on film surfaces leads to the attraction of dust, which can produce physical defects. The discharge of accumulated charge during or after the application of the sensitized emulsion layers can produce irregular fog patterns or static marks in the emulsion. The severity of the static problems has been exacerbated greatly by the increases in sensitivity of new emulsions, increases in coating machine speeds, and increases in post-coating drying efficiency. The charge generated during the coating process results primarily from the tendency of webs of high dielectric constant polymeric film base to undergo triboelectric charging during winding and unwinding operations, during transport through the coating machines, and during post-coating operations such as slitting, perforating, and spooling. Static charge can also be generated during the use of the finished photographic product. In an automatic camera, because of the repeated motion of the photographic film in and out of the film cassette, there is the added problem of the generation of electrostatic charge by the movement of the film across the magnetic heads and by the repeated winding and unwinding operations, especially in a low relative humidity environment. The accumulation of charge on the film surface results in the attraction and adhesion of dust to the film. The presence of dust not only can result in the introduction of physical defects and the degradation of the image quality of the photographic element but also can result in the introduction of noise and the degradation of magnetic recording performance (e.g., S/N ratio, "drop-outs", etc.). This degradation of magnetic recording performance can arise from various sources including signal loss resulting from increased head-media spacing, electrical noise caused by discharge of the static charge by the magnetic head during playback, uneven film transport across the magnetic heads, clogging of the magnetic head gap, and excessive wear of the magnetic heads. In order to prevent these problems arising from electrostatic charging, there are various well known methods by which an electrically-conductive layer can be introduced into the photographic element to dissipate any accumulated electrostatic charge.

Antistatic layers containing electrically-conductive agents can be applied to one or both sides of the film base as subbing layers either beneath or on the side opposite to the silver halide emulsion layers. An antistatic layer also can be applied as an outermost layer overlying the emulsion layers or on the side opposite to the emulsion layers or on both sides of the film base. For some applications, it may be advantageous to incorporate the antistatic agent directly into the film base or to introduce it into a silver halide emulsion layer. Typically, in photographic elements of prior art having a transparent magnetic recording layer, the antistatic layer was preferably present as a backing layer underlying the magnetic recording layer.

The use of such electrically-conductive layers containing suitable semi-conductive metal oxide particles dispersed in a film-forming binder in combination with a transparent magnetic recording layer in silver halide imaging elements has been described in the following examples of the prior art. Photographic elements including a transparent magnetic recording layer and a transparent electrically-conductive layer both located on the backside of the film base have been described in U.S. Pat. Nos. 5,147,768; 5,229,259; 5,294,525; 5,336,589; 5,382,494; 5,413,900; 5,457,013; 5,459,021; 5,707,791 and others. The conductive layers described in these patents contain fine granular particles of a semi-conductive crystalline metal oxide such as zinc oxide, titania, tin oxide, alumina, indium oxide, silica, complex or compound oxides thereof, and zinc antimonate and indium antimonate dispersed in a polymeric film-forming binder. Of these conductive metal oxides, antimony-doped tin oxide and zinc antimonate are preferred. A granular, antimony-doped tin oxide particle commercially available from Ishihara Sangyo Kaisha under the tradename "SN-100P" was disclosed as particularly preferred in Japanese Kokai Nos. 04-062543, 06-161033, and 07-168293.

Preferred average diameters for granular conductive metal oxide particles in such conductive layers was disclosed to be less than 0.5 $\mu$m in U.S. Pat. No. 5,294,525; 0.02 to 0.5 $\mu$m in U.S. Pat. No. 5,382,494; 0.01 to 0.1 $\mu$m in U.S. Pat. Nos. 5,459,021 and 5,457,013; and 0.01 to 0.05 $\mu$m in U.S. Pat. No. 5,457,013. Suitable conductive metal oxide particles exhibit specific volume resistivities of $1\times10^{10}$ ohm·cm or less, preferably $1\times10^{7}$ ohm·cm or less, and more preferably $1\times10^{5}$ ohm·cm or less as taught in U.S. Pat. No. 5,459,021. Another physical property used to characterize crystalline metal oxide particles is the average x-ray crystallite size. The concept of crystallite size is described in detail in U.S. Pat. No. 5,484,694 and references cited therein. Transparent conductive layers containing semiconductive antimony-doped tin oxide granular particles exhibiting a preferred crystallite size of less than 10 nm are taught in U.S. Pat. No. 5,484,694 to be particularly useful in imaging elements. Similarly, photographic elements having transparent magnetic layers in combination with conductive layers containing granular conductive metal oxide particle with average crystallite sizes ranging from 1 to 20 nm, preferably 1 to 5 nm, and more preferably from 1 to 3.5 nm are claimed in U.S. Pat. No. 5,459,021. Advantages to using metal oxide particles with small crystallite sizes are disclosed in U.S. Pat. Nos. 5,484,694 and 5,459,021 including the ability to be milled to a very small size without significant degradation of electrical performance, ability to produce a specified level of conductivity at lower weight loadings and/or dry coverages, as well as decreased optical density, decreased brittleness, and decreased cracking of conductive layers containing such particles. Conductive layers containing such metal oxide particles have been applied at the following preferred ranges of dry weight coverages of metal oxide: 3.5 to 10 g/m$^2$; 0.1 to 10 g/m$^2$; 0.002 to 1 g/m$^2$; 0.05 to 0.4 g/m$^2$ as disclosed in U.S. Pat. Nos. 5,382,494; 5,457,013; 5,459,021; and 5,294,525, respectively. Preferred ranges for the metal oxide content in the conductive layers include: 17 to 67% by weight, 43 to 87.5% by weight, and 30 to 40% by volume as disclosed in U.S. Pat. Nos. 5,294,525; 5,382,494; and 5,459,021, respectively.

Conductive subbing and backing layers for graphic arts films containing "short fibre", "needle-like" or "fibrous" conductive materials have been described in: U.S. Pat. Nos. 5,122,445 and 4,999,276; European Application No. 404,091; Japanese Kokai No. 04-97339. Suitable fibrous conductive materials include non-conductive fibrous $TiO_2$ particles overcoated with a thin layer of conductive metal oxide fine particles as described in Japanese Kokai No. 59-006235. Preferred conductive fibrous particles were disclosed to exhibit average lengths of 25 $\mu$m and diameters of 0.5 $\mu$m, with a length:diameter ratio of about 3 or greater. Conductive backings for silver halide photographic films containing fibrous conductive metal oxides of Zn, Ti, Sn, Al, In, Si, Mg, Ba, Mo, W or V or multi-component oxides thereof coated at a dry coverage of about 0.3 g/m$^2$ with an optional fluorosurfactant are described in Japanese Kokai Nos. 04-27937 and 04-29134. Other photographic films in which conductive $K_2Ti_6O_{13}$ whiskers available from Otsuka Chemical under the tradename "Dentall WK-100S" are incorporated in subbing, backing or surface protective layers at dry coverages of 0.1–10 g/m$^2$ are described in Japanese Kokai No. 63-98656. Silver halide laser scanner films containing conductive fibers 10 $\mu$m or less in length, 0.3 $\mu$m or less in diameter, and having a ratio of length to diameter of 3 or more are disclosed in U.S. Pat. No. 5,582,959. The use of conductive $K_2Ti_6O_{13}$ whiskers 0.05–1 $\mu$m in diameter and 1–25 $\mu$m in length dispersed in the emulsion layer of such films is disclosed in Japanese Kokai No. 63-287849. Conductive coatings for photographic papers containing fibrous $TiO_2$ particles or $K_2Ti_6O_{13}$ whiskers coated with conductive antimony-doped $SnO_2$ particles have been described in European Application No. 616,252 and Japanese Kokai No. 01-262537.

Thermal media with conductive layers containing fibrous conductive metal oxide particles 0.3 $\mu$m in diameter and 10 $\mu$m in length are described in Japanese Kokai No. 07-295146. Thermographic media coated with ZnO, $Si_3N_4$ or $K_2Ti_6O_{13}$ conductive whiskers are described in World Patent Application No. 91-05668.

Conductive layers for electrostatic recording films containing fibrous conductive particles are described in U.S. Pat. No. 5,116,666 and Japanese Kokai No. 63-60452. The preferred fibrous conductive particles were disclosed to be obtained commercially from Otsuka Chemical under the tradename "Dentall WK200B". Such particles consist of a thin layer of conductive antimony-doped tin oxide particles deposited on the surface of a nonconductive $K_2Ti_6O_{13}$ core particle. An electrostatic recording paper having a conductive layer containing such conductive $K_2Ti_6O_{13}$ whiskers also has been described in Japanese Kokai, No. 02-307551. An electrophotographic support containing rod-shaped conductive ZnO particles is described in World Patent Application No. 94-25966.

A silver halide photographic film including a transparent magnetic recording layer and a conductive backing or subbing layer containing fibrous $TiO_2$ particles surface-coated with a thin layer of conductive antimony-doped $SnO_2$ particles has been taught in a Comparative Example in U.S. Pat. No. 5,459,021. The average size of the fibrous composite conductive particles was about 0.2 $\mu$m in diameter and 2.9 $\mu$m in length. Further, the fibrous composite particles were reported to exhibit a crystallite size of 22.3 nm. Such fibrous composite conductive particles are commercially available from Ishihara Sangyo Kaisha under the tradename "FT-200". However, conductive layers containing these fibrous composite particles also were disclosed to exhibit fine cracks which resulted in decreased conductivity, increased haze, and decreased adhesion compared to similar layers containing granular conductive tin oxide particles.

The use of crystalline, single-phase, acicular, conductive metal-containing particles in transparent conductive layers for various types of imaging elements also containing a transparent magnetic recording layer has been disclosed in U.S. Pat. No. 5,731,119 incorporated herein by reference. Suitable acicular, conductive metal-containing particles were disclosed therein to have a cross-sectional diameter of 0.02 $\mu$m or less and an aspect ratio (length to cross-sectional diameter) greater than or equal to 5:1. An aspect ratio greater than or equal to 10:1 was disclosed to be preferred.

However, there is a common deficiency in the electrical performance of conductive layers containing either granular or acicular conductive metal-containing particles which is manifested as a substantial decrease in electrical conductivity of such conductive layers after an overlying transparent magnetic recording layer is applied. For example, surface resistivity values were reported in U.S. Pat. No. 5,382,494 for conductive layers containing 75 weight percent or more granular antimony-doped tin oxide particles dispersed in nitrocellulose, cellulose diacetate, or gelatin as binder measured prior to overcoating with a magnetic recording layer as ranging from $1\times10^5$ to $1\times10^6$ ohms/square for tin oxide dry weight coverages of 3.5 to 12 g/m$^2$. However, after overcoating with a magnetic recording layer, the surface resistivity values increased to $1\times10^6$ to $1\times10^9$ ohms/square. Similarly, surface resistivity values of $1\times10^9$ to $1\times10^{10}$ ohms/square were reported in U.S. Pat. No. 5,459,021 for conductive subbing layers containing granular antimony-doped tin oxide particles dispersed in gelatin as binder after overcoating with a magnetic recording layer. Conductive subbing layers containing other granular conductive metal oxide particles, such as zinc antimonate, exhibit similar behavior when overcoated with a magnetic recording layer. For example, conductive layers containing less than 75 weight percent zinc antimonate particles dispersed in a vinylidene chloride-based terpolymer latex as binder are reported in U.S. Pat. No. 5,457,013 to exhibit surface resistivity values of $1\times10^8$ ohms/square for total dry weight coverages of about 0.5–0.65 g/m$^2$. After overcoating with a magnetic recording layer, the internal resistivity of the conductive layers increased to $1\times10^{10}$ to $1\times10^{11}$ ohms/square. Similarly, conductive layers containing 75 weight percent acicular tin oxide particles dispersed in a vinylidene chloride-based terpolymer latex as binder are reported in U.S. Pat. No. 5,719,016 to exhibit surface resistivity values of from $1\times10^6$ to $1\times10^9$ ohms/square for total dry weight coverages of from 0.6 to 0.2 g/m$^2$. After overcoating with a magnetic recording layer as above, the internal resistivity values of such conductive layers are reported in U.S. Pat. No. 5,731,119 to increase to $1\times10^8$ to $1\times10^{12}$ ohms/square. Thus, in order to maintain a preferred level of conductivity after overcoating with a magnetic recording layer, conductive layers containing either granular or acicular conductive particles need to contain a higher concentration, a higher weight coverage or both of conductive particles than conductive layers which are not overcoated.

Because the requirements for an electrically-conductive layer to be useful in an imaging element are extremely demanding, the art has long sought to develop improved conductive layers exhibiting a balance of the necessary chemical, physical, optical, and electrical properties. As indicated hereinabove, the prior art for providing electrically-conductive layers useful for imaging elements is extensive and a wide variety of suitable electroconductive materials have been disclosed. However, there is still a critical need for improved conductive layers which can be used in a wide variety of imaging elements, which can be manufactured at a reasonable cost, which are resistant to the effects of humidity change, which are durable and abrasion-resistant, which do not exhibit adverse sensitometric or photographic effects, which exhibit acceptable adhesion to overlying or underlying layers, which exhibit suitable cohesion, and which are substantially insoluble in solutions with which the imaging element comes in contact, such as processing solutions used for photographic elements. Further, to provide both effective magnetic recording properties and effective electrical-conductivity characteristics in an imaging element, without impairing its imaging characteristics, poses a considerably greater technical challenge.

It is toward the objective of providing a useful combination of a transparent magnetic recording layer overlying an electrically-conductive layer containing metal-containing particles dispersed in a polymeric film-forming binder without causing degradation of the physical or electrical properties of the conductive layer that more effectively meets the diverse needs of imaging elements, especially those of silver halide photographic films and thermally processable imaging elements, but also of a wide variety of other types of imaging elements than those of the prior art that the present invention is directed.

SUMMARY OF THE INVENTION

The present invention is an imaging element which includes a support and at least one image-forming layer superposed on the support. The imaging element includes at least one transparent electrically-conductive layer and a transparent magnetic recording layer overlying the transparent electrically-conductive layer. The electrically conductive layer is composed of both electrically-conductive granular metal-containing colloidal particles having an average particle diameter of less than or equal to 0.05 $\mu$m and electrically-conductive acicular metal-containing particles having a cross-sectional diameter of less than or equal to 0.02 $\mu$m and an aspect ratio greater than or equal to 5:1 dispersed in a first film-forming binder. The transparent magnetic recording layer is composed of magnetic particles dispersed in a second film-forming binder.

DETAILED DESCRIPTION OF THE INVENTION

The present invention provides an imaging element for use in an image-forming process including a support, at least one imaging layer, a transparent magnetic recording layer, and at least one electrically-conductive layer, wherein the electrically-conductive layer contains both acicular, crystalline, electrically-conductive metal-containing particles having a cross-sectional diameter $\leqq$0.02 $\mu$m and an aspect ratio (length to cross-sectional diameter) $\geqq$5:1 and granular, electrically-conductive metal-containing colloidal particles having an average particle diameter $\leqq$0.05 $\mu$m dispersed in one or more film-forming binders. For imaging elements in which the transparent magnetic recording layer is superposed on an electrically-conductive layer, the increase in the resistivity of the conductive layer produced by the application of the magnetic recording layer is substantially less for conductive layers containing a combination of granular and acicular conductive particles compared to corresponding conductive layers containing either granular or acicular conductive particles. Thus, the resulting internal electrical resistivities for the conductive layers underlying a transparent magnetic recording layer of this invention are lower than those for conductive layers containing similar volume concentrations and dry weight coverages of granular conductive particles not substituted by acicular conductive particles. Further, the electrical conductivity afforded by conductive layers of this invention is nearly independent of relative humidity and persists after photographic processing. Also, the net optical and ultraviolet densities (i.e., $\Delta D_{min}$) of the combined conductive and magnetic recording layers are typically less than those for conductive layers containing similar volume concentrations and dry weight coverages of granular conductive particles not substituted by acicular conductive particles.

One class of conductive metal-containing granular particles particularly useful for the electrically-conductive layers of this invention are semiconductive metal oxide particles. Other examples of useful electrically-conductive, metal-containing granular particles include selected metal carbides, nitrides, silicides, and borides. Examples of suitable semiconductive metal oxides include: zinc oxide, titania, tin oxide, alumina, indium oxide, zinc antimonate, indium antimonate, molybdenum trioxide, tungsten trioxide, and vanadium pentoxide. Suitable semiconductive metal oxide particles are those which exhibit specific (volume) resistivity values ranging from about $1\times10^{-2}$ to $1\times10^{5}$ ohm·cm, preferably from about $1\times10^{-1}$ to $1\times10^{3}$ ohm·cm. Such semiconductive metal oxides are typically doped with donor heteroatoms or exhibit an oxygen atom deficiency. Another physical property used to characterize metal oxide granular particles is the average x-ray crystallite size. The concept of x-ray crystallite size is described in detail in U.S. Pat. No. 5,484,694 and references cited therein. Transparent conductive layers containing semiconductive antimony-doped tin oxide granular particles exhibiting a crystallite size less than 10 nm are taught in U.S. Pat. No. 5,484,694 to be particularly preferred for use in imaging elements. Similarly, photographic elements having antistatic layers containing conductive granular metal oxide particles with average x-ray crystallite sizes ranging from 1 to 20 nm, preferably from 1 to 5 nm, and more preferably from 1 to 3.5 nm are claimed in U.S. Pat. No. 5,459,021. Advantages to using metal oxide particles with small crystallite size are disclosed in U.S. Pat. Nos. 5,484,694 and 5,459,021 and include the ability to be milled to a very small size without degradation of electrical performance, the ability to produce a specified level of conductivity for coated layers at lower dry weight coverages, as well as decreased optical density, brittleness, and cracking of conductive layers containing such particles.

The semiconductive metal oxide most widely used in conductive layers for imaging elements is antimony-doped tin oxide. Antimony-doped tin oxide granular particles preferred for use in accordance with this invention exhibit a very small primary particle size, typically less than 0.020 $\mu$m. Such a small particle size minimizes light scattering which could result in reduced optical transparency of the conductive layer. In addition to ensuring transparency of the conductive layers, a small average particle size is needed to form a multiplicity of interconnected chains or a network of conductive particles which provide multiple electrically-conductive pathways. An example of a suitable antimony-doped tin oxide is the electroconductive tin oxide powder available under the tradename "SN-100P" from Ishihara Techno Corporation. This conductive tin oxide is composed of granular particles of single phase, crystalline tin oxide doped with about 5–10 weight percent antimony. The specific (volume) resistivity of this antimony-doped tin oxide powder is about 1–10 ohm·cm when measured as a packed powder using a DC two-probe test cell similar to that described in U.S. Pat. No. 5,236,737. The average equivalent circular diameter of the primary particles as determined by image analysis of transmission electron micrographs is approximately 0.005–0.015 $\mu$m. An x-ray powder diffraction analysis of this antimony-doped tin oxide has confirmed that it is single phase and highly crystalline. The typical mean value for x-ray crystallite size determined by the method described in U.S. Pat. No. 5,484,694 is about 3.5–4.5 nm.

Acicular, conductive metal-containing particles used in accordance with this invention are preferably single phase, crystalline, and have nanometer-size dimensions. Suitable dimensions for the acicular particles are less than 0.050 $\mu$m in cross-sectional diameter (minor axis) and less than 1 $\mu$m in length (major axis), preferably less than 0.020 $\mu$m in cross-sectional diameter and less than 0.500 $\mu$m in length, and more preferably less than 0.010 $\mu$m in cross-sectional diameter and less than 0.150 $\mu$m in length. These dimensions tend to minimize optical losses of coated layers containing such particles due to Mie-type scattering by the particles. A mean aspect ratio (major/minor axes) of at least 2:1 is suitable; a mean aspect ratio of greater than or equal to 5:1 is preferred; and a mean aspect ratio of greater than or equal to 10:1 is more preferred. An increase in mean aspect ratio of acicular conductive particles results in an improvement in the volumetric efficiency of conductive network formation.

As disclosed in U.S. Pat. No. 5,719,016, one particularly useful class of acicular, electrically-conductive, metal-containing particles is acicular, semiconductive metal oxide particles. Acicular, semiconductive metal oxide particles suitable for use in the conductive overcoat layers of this invention exhibit specific (volume) resistivity values ranging from about $1\times10^{-2}$ to $1\times10^{4}$ ohm·cm, more preferably from about $1\times10^{-1}$ to $1\times10^{3}$ ohm·cm. One example of a preferred acicular semiconductive metal oxide is the acicular electroconductive tin oxide described in U.S. Pat. No. 5,575,957 which is available under the tradename "FS-10P" from Ishihara Techno Corporation. This electroconductive tin oxide consists of acicular particles of single phase, crystalline tin oxide doped with about 0.3–5 atom percent antimony. The specific (volume) resistivity of the FS-10P acicular tin oxide ranges from about 10 to 100 ohm·cm when measured as a packed powder using a DC two-probe test cell similar to that described in U.S. Pat. No. 5,236,737. The mean dimensions of such acicular tin oxide particles determined by image analysis of transmission electron micrographs are approximately 0.010 $\mu$m in cross-sectional diameter and 0.100 $\mu$m in length with a mean aspect ratio of about 10:1. An x-ray powder diffraction analysis of the FS-10P acicular tin oxide has confirmed that it is single phase and highly crystalline. The typical mean value for x-ray crystallite size determined in the manner described in U.S. Pat. No. 5,484,694 is about 200 Å for the as-supplied dry powder. Other suitable acicular electroconductive metal oxides include, for example, a tin-doped indium sesquioxide similar to that described in U.S. Pat. No. 5,580,496, but having a smaller mean cross-sectional diameter; an aluminum-doped zinc oxide; a niobium-doped titanium dioxide; an oxygen-deficient titanium suboxide, $TiO_x$, where $x<2$; and a titanium oxynitride, $TiO_xN_y$, where $(x+y)\leqq2$, similar to those phases described in U.S. Pat. No. 5,320,782. Additional examples of other suitable non-oxide, acicular, electrically-conductive, metal-containing particles can include selected transition metal carbides, metal nitrides, metal silicides, metal borides, and metal pnictides.

The granular and acicular conductive particles incorporated in electrically-conductive layers of this invention can have the same metal-containing compositions. Suitable metal-containing conductive particles include colloidal particles of semiconductive metal oxides such as zinc oxide, titania, tin oxide, alumina, indium oxide, complex or compound oxides thereof, and zinc antimonate or indium antimonate. Antimony-doped tin oxide is the preferred metal oxide for both acicular and granular conductive particles.

The use of acicular and granular metal-containing conductive particles with small average dimensions in accordance with this invention minimizes the amount of light scattering and results in increased optical transparency and decreased haze for conductive layers in which they are both incorporated. The higher effective aspect ratio of the preferred acicular conductive particles results in greater efficiency of conductive network formation compared to granular conductive particles of comparable cross-sectional diameter. The volume concentration of metal-containing particles in conductive layers suitable for use in imaging elements of this invention can range from about 2 to 50 volume percent. The concentration of conductive particles is defined in terms of volume percent rather than weight percent since the densities of the various suitable conductive acicular and granular particles can vary for different particle compositions. The use of significantly less than about 2 volume percent acicular conductive particles will not provide a useful level of electrical conductivity. Similarly, the use of significantly less than about 15 volume percent granular conductive particles, in the absence of acicular conductive particles, will not provide a useful level of electrical conductivity. The optimum concentration of either granular or acicular conductive particles depends on primary particle size, agglomerate size, polymeric binder, as well as the conductivity requirements of the particular imaging element.

As described hereinabove, a common deficiency in the electrical performance of conductive layers of prior art containing either granular or acicular metal-containing conductive particles is manifested as a substantial increase in electrical resistivity when an additional layer, such as a protective overcoat or topcoat, an abrasion-resistant backing, a gelatin-containing pelloid, an emulsion layer or a magnetic recording layer has been applied onto such conductive layers. Furthermore, this change in resistivity possibly demonstrates a lack of robustness of the extended conductive network in the conductive layer. Rewetting of the surface of the conductive layer and penetration by coating solvent into the bulk of the conductive layer during the overcoating process can cause swelling of the binder of the conductive layer and intermixing of the layers at the common interface which can result in an increase in resistivity of the overcoated conductive layer. The magnitude of this increase in the electrical resistivity depends on a variety of factors including binder selection for both layers, coating solvent selection, volumetric concentration of conductive particles in the conductive layer, type of conductive particle, total dry weight coverage for both layers, drying conditions for both layers, and other process-related factors. One advantage provided by the conductive layers of the present invention, which contain acicular conductive particles partially substituted for granular conductive particles, is a minimization of the magnitude of this increase in resistivity relative to that for conductive layers of prior art containing either granular or acicular conductive particles at the same total volume concentrations and dry weight coverages of conductive particles. Another advantage provided by the conductive layers of this invention is that $\Delta$UV $D_{min}$ and $\Delta$Ortho $D_{min}$ values for the combined conductive and magnetic recording layers are less than for such combined layers having conductive layers containing granular conductive particles and less than or equal to those for such combined layers having conductive layers containing acicular conductive particles for comparable total conductive particle volume concentrations and total dry weight coverages.

In accordance with the present invention, as much as 90% of the granular conductive particles in a conductive layer can be substituted by acicular particles for conductive layers containing greater than about 10% by volume total conductive particles in order to minimize the increase in resistivity as well as decrease optical and UV densities after overcoating. Typically, layers containing less than about 10% by volume granular conductive particles without any acicular conductive particles are not conductive. Further, conductive layers containing greater than about 50% by volume granular conductive particles exhibit changes in resistivity after overcoating that are relatively small even without partial substitution of granular conductive particles by acicular conductive particles. As disclosed in U.S. Pat. No. 5,719,016 the inclusion of greater than about 2% by volume acicular conductive metal-containing particles in conductive layers can provide a useful level of surface conductivity. However, in the absence of a suitable volume concentration of granular conductive particles, conductive layers containing such low volume concentrations of acicular conductive particles typically become non-conductive when overcoated. Conductive layers containing about 30% by volume acicular conductive particles in the absence of granular conductive particles were reported in U.S. Pat. Nos. 5,719,016 and 5,731,119 to exhibit large increases in resistivity when overcoated with a transparent magnetic recording layer. For the conductive layers of the present invention, suitable volume concentrations can range from about 5 to 30% for granular metal-containing conductive particles, from about 5 to 20% for acicular metal-containing conductive particles, and from about 50 to 90% for the film-forming polymeric binder. Preferred volume concentrations range from about 7 to 20% for granular conductive metal-containing particles, from about 5 to 15% for acicular metal-containing conductive particles, and from about 65 to 88% for polymeric binder.

Polymeric film-forming binders useful in conductive layers prepared by the method of this invention include: water-soluble, hydrophilic polymers such as gelatin, gelatin derivatives, maleic acid anhydride copolymers; cellulose derivatives such as carboxymethyl cellulose, hydroxyethyl cellulose, cellulose acetate butyrate, diacetyl cellulose or triacetyl cellulose; synthetic hydrophilic polymers such as polyvinyl alcohol, poly-N-vinylpyrrolidone, acrylic acid copolymers, polyacrylamide, their derivatives and partially hydrolyzed products, vinyl polymers and copolymers such as polyvinyl acetate and polyacrylate acid ester; derivatives of the above polymers; and other synthetic resins. Other suitable binders include aqueous emulsions of addition-type polymers and interpolymers prepared from ethylenically unsaturated monomers such as acrylates including acrylic acid, methacrylates including methacrylic acid, acrylamides and methacrylamides, itaconic acid and its half-esters and diesters, styrenes including substituted styrenes, acrylonitrile and methacrylonitrile, vinyl acetates, vinyl ethers, vinyl and vinylidene halides, and olefins and aqueous dispersions of polyurethanes or polyesterionomers. Gelatin and gelatin derivatives, aqueous dispersed polyurethanes and polyesterionomers, and aqueous emulsions of vinylidene halide interpolymers are the preferred binders.

Solvents useful for preparing dispersions and coatings containing mixtures of granular and acicular metal-containing particles by the method of this invention include: water; alcohols such as methanol, ethanol, propanol, isopropanol; ketones such as acetone, methylethyl ketone, and methylisobutyl ketone; esters such as methyl acetate, and ethyl acetate; glycol ethers such as methyl cellusolve, ethyl cellusolve; ethylene glycol, and mixtures thereof. Preferred solvents include water, alcohols, and acetone.

In addition to binders, other components that are well known in the photographic art also can be included in the conductive layer of this invention. Other addenda, such as matting agents, surfactants or coating aids, charge control agents, polymer lattices to improve dimensional stability, thickeners or viscosity modifiers, hardeners or cross linking agents, soluble antistatic agents, soluble and/or solid particle dyes, antifoggants, lubricating agents, and various other conventional additives optionally can be present in any or all of the layers of the multilayer imaging element.

Dispersions of mixtures of granular and acicular metal-containing particles in a suitable liquid vehicle can be prepared in the presence of appropriate levels of optional dispersing aids, colloidal stabilizing agents or polymeric co-binders by any of various wet milling processes well-known in the art of pigment dispersion and paint making. Liquid vehicles useful for preparing such dispersions include water; aqueous salt solutions; alcohols such as methanol, ethanol, propanol, butanol; ethylene glycol; and other solvents described hereinabove. The dispersing aid can be chosen from a wide variety of surfactants and surface modifiers such as those described in U.S. Pat. No. 5,145,684, for example. The dispersing aid can be present in an amount ranging from 0.1 to 20% of the dry weight of the conductive particles.

Colloidal dispersions of mixtures of granular and acicular metal-containing particles in suitable liquid vehicles can be formulated with a polymeric film-forming binder and various addenda and applied to a variety of supports to form the electrically-conductive layers of this invention. Typical photographic film supports include: cellulose nitrate, cellulose acetate, cellulose acetate butyrate, cellulose acetate propionate, poly(vinyl acetal), poly(carbonate), poly (styrene), poly(ethylene terephthalate), poly(ethylene naphthalate) or poly(ethylene naphthalate) having included therein a portion of isophthalic acid, 1,4-cyclohexane dicarboxylic acid or 4,4-biphenyl dicarboxylic acid used in the preparation of the film support; polyesters wherein other glycols are employed such as, for example, cyclohexanedimethanol, 1,4-butanediol, diethylene glycol, polyethylene glycol; ionomers as described in U.S. Pat. No. 5,138,024, incorporated herein by reference, such as polyester ionomers prepared using a portion of the diacid in the form of 5-sodiosulfo-1,3-isophthalic acid or like ion containing monomers, polycarbonates, and the like; blends or laminates of the above polymers. Supports can be either transparent or opaque depending upon the application. Transparent film supports can be either colorless or colored by the addition of a dye or pigment. Film supports can be surface-treated by various processes including corona discharge, glow discharge, UV exposure, flame treatment, electron-beam treatment, as described in U.S. Pat. No. 5,718,995 or treatment with adhesion-promoting agents including dichloro- and trichloroacetic acid, phenol derivatives such as resorcinol and p-chloro-m-cresol, solvent washing or overcoated with adhesion promoting primer or tie layers containing polymers such as vinylidene chloride-containing copolymers, butadiene-based copolymers, glycidyl acrylate or methacrylate-containing copolymers, maleic anhydride-containing copolymers, condensation polymers such as polyesters, polyamides, polyurethanes, polycarbonates, mixtures and blends thereof, and the like. Other suitable opaque or reflective supports are paper, polymer-coated paper, including polyethylene-, polypropylene-, and ethylene-butylene copolymer-coated or laminated paper, synthetic papers, pigment-containing polyesters, and the like. Of these supports, films of cellulose triacetate, poly(ethylene terephthalate), and poly(ethylene naphthalate) prepared from 2,6-naphthalene dicarboxylic acids or derivatives thereof are preferred. The thickness of the support is not particularly critical. Support thicknesses of 2 to 10 mils (50 $\mu$m to 254 $\mu$m) are suitable for photographic elements in accordance with this invention.

Dispersions containing mixtures of granular and acicular metal-containing particles, a polymeric film-forming binder, and various additives in a suitable liquid vehicle can be applied to the aforementioned film or paper supports using any of a variety of well-known coating methods. Handcoating techniques include using a coating rod or knife or a doctor blade. Machine coating methods include air doctor coating, reverse roll coating, gravure coating, curtain coating, bead coating, slide hopper coating, extrusion coating, spin coating and the like, as well as other coating methods known in the art.

The electrically-conductive layer of this invention can be applied to the support at any suitable coverage depending on the specific requirements of a particular type of imaging element. For example, for silver halide photographic films, total dry coating weights of antimony-doped tin oxide in the conductive layer are preferably in the range of from about 0.01 to 2 g/m$^2$. More preferred dry weight coverages are in the range of about 0.02 to 1 g/m$^2$. The conductive layer of this invention typically exhibits a surface resistivity (20% RH, 20° C.) of less than $1\times10^{10}$ ohms/square, preferably less than $1\times10^{9}$ ohms/square, and more preferably less than $1\times10^{8}$ ohms/square.

Imaging elements including a transparent magnetic recording layer are well known in the imaging art as described hereinabove. Such a transparent magnetic recording layer can contain a polymeric film-forming binder, ferromagnetic particles, and other optional addenda for improved manufacturabilty or performance such as dispersants, coating aids, fluorinated surfactants, crosslinking agents or hardeners, catalysts, charge control agents, lubricants, abrasive particles, filler particles, and the like as described, for example, in Research Disclosure, Item No. 34390 (November, 1992).

Suitable ferromagnetic particles include ferromagnetic iron oxides, such as: $\gamma$-$Fe_2O_3$, $Fe_3O_4$; $\gamma$-$Fe_2O_3$ or $Fe_3O_4$ bulk-doped or surface-treated with Co, Zn, Ni or other metals; ferromagnetic chromium dioxides such as $CrO_2$ or $CrO_2$ doped with Li, Na, Sn, Pb, Fe, Co, Ni, Zn or halogen atoms in solid solution; ferromagnetic transition metal ferrites; ferromagnetic hexagonal ferrites, such as barium and strontium ferrite; and ferromagnetic metal alloys with oxide coatings on their surface to improve chemical stability and/or dispersibility. In addition, ferromagnetic oxides with a shell of a lower refractive index particulate inorganic material or a polymeric material with a lower optical scattering cross-section as taught in U.S. Pat. Nos. 5,217,804 and 5,252,444 can be used. Suitable ferromagnetic particles exhibit a variety of sizes, shapes and aspect ratios. The preferred ferromagnetic particles for magnetic recording layers used in combination with the conductive layers of this invention are cobalt surface-treated $\gamma$-iron oxide with a specific surface area greater than 30 m$^2$/g.

As taught in U.S. Pat. No. 3,782,947, whether an element is useful for both photographic and magnetic recording depends on the size distribution and concentration of the ferromagnetic particles as well as the relationship between the granularities of the magnetic and the photographic layers. Generally, the coarser the grain of the silver halide emulsion in the photographic element containing a magnetic recording layer, the larger the mean size of the magnetic particles which are suitable can be. A magnetic particle coverage of from about 10 to 1000 $mg/m^2$, when uniformly distributed across the imaging area of a photographic imaging element, provides a magnetic recording layer that is suitably transparent to be useful for photographic imaging applications for particles with a maximum dimension of less than about 1 $\mu$m. Magnetic particle coverages less than about 10 $mg/m^2$ tend to be insufficient for magnetic recording purposes. Magnetic particle coverages greater than about 1000 $mg/m^2$ tend to produce magnetic recording layers with optical densities too high for photographic imaging. Particularly useful particle coverages are in the range of 20 to 70 $mg/m^2$. Coverages of about 20 $mg/m^2$ are particularly useful in magnetic recording layers for reversal films and coverages of about 40 $mg/m^2$ are particularly useful in magnetic recording layers for negative films. Magnetic particle concentrations of from about $1\times10^{-11}$ to $1\times10^{-10}$ $mg/\mu m^3$ are preferred for transparent magnetic recording layers prepared for use in accordance with this invention.

Suitable polymeric binders for use in the magnetic recording layer include, for example: vinyl chloride-based copolymers such as, vinyl chloride-vinyl acetate copolymers, vinyl chloride-vinyl acetate-vinyl alcohol terpolymers, vinyl chloride-vinyl acetate-maleic acid terpolymers, vinyl chloride-vinylidene chloride copolymers, vinyl chloride-acrylonitrile copolymers; acrylic ester-acrylonitrile copolymers, acrylic ester-vinylidene chloride copolymers, methacrylic ester-vinylidene chloride copolymers, methacrylic ester-styrene copolymers, thermoplastic polyurethane resins, phenoxy resins, polyvinyl fluoride, vinylidene chloride-acrylonitrile copolymers, butadiene-acrylonitrile copolymers, acrylonitrile-butadiene-acrylic acid terpolymers, acrylonitrile-butadiene-methacrylic acid terpolymers, polyvinyl butyral, polyvinyl acetal, cellulose derivatives such as cellulose esters including cellulose acetate, cellulose diacetate, cellulose triacetate, cellulose acetate butyrate, cellulose acetate proprionate; and styrene-butadiene copolymers, polyester resins, phenolic resins, thermosetting polyurethane resins, melamine resins, alkyl resins, urea-formaldehyde resins and the like. Preferred binders for organic solvent-coated transparent magnetic recording layers are polyurethanes, vinyl chloride-based copolymers, and cellulose esters, particularly cellulose diactetate and cellulose triacetate.

Binders for transparent magnetic recording layers also can be film-forming hydrophilic polymers such as water soluble polymers, cellulose ethers, latex polymers and water-dispersible polyesters as described in *Research Disclosures* No. 17643 and 18716 and U.S. Pat. Nos. 5,147,768; 5,457,012; 5,520,954 and 5,531,913. Suitable water-soluble polymers include gelatin, gelatin derivatives, casein, agar, starch, polyvinyl alcohol, acrylic acid copolymers, and maleic acid anhydride. Suitable cellulose ethers include carboxymethyl cellulose and hydroxyethyl cellulose. Other suitable aqueous binders include aqueous lattices of addition-type polymers and interpolymers prepared from ethylenically unsaturated monomers such as acrylates including acrylic acid, methacrylates including methacrylic acid, acrylamides and methacrylamides, itaconic acid and its half-esters and diesters, styrenes including substituted styrenes, acrylonitrile and methacrylonitrile, vinyl acetates, vinyl ethers, vinyl chloride copolymers and vinylidene chloride copolymers, and butadiene copolymers and aqueous dispersions of polyurethanes or polyesterionomers. Preferred hydrophilic binders include gelatin, gelatin derivatives, and combinations of gelatin with a polymeric cobinder. Preferred gelatins include alkali- or acid-treated gelatins.

The binder in the magnetic recording layer can be optionally cross-linked. Binders which contain active hydrogen atoms including —OH, —$NH_2$, —NHR, where R is an organic radical, and the like, can be crosslinked using an isocyanate or polyisocyanate as described in U.S. Pat. No. 3,479,310. Suitable polyisocyanates include: tetramethylene diisocyanate, hexamethylene diisocyanate, diisocyanato dimethylcyclohexane, dicyclohexylmethane diisocyanate, isophorone diisocyanate, dimethylbenzene diisocyanate, methylcyclohexylene diisocyanate, lysine diisocyanate, tolylene diisocyanate, diphenylmethane diisocyanate, and polymers thereof; polyisocyanates prepared by reacting an excess of an organic diisocyanate with an active hydrogen containing compounds such as polyols, polyethers and polyesters and the like, including ethylene glycol, propylene glycol, dipropylene glycol, butylene glycol, trimethylol propane, hexanetriol, glycerine sorbitol, pentaerythritol, castor oil, ethylenediamine, hexamethylenediamine, ethanolamine, diethanolamine, triethanolamine, water, ammonia, urea, and the like, including biuret compounds, allophanate compounds, and the like. One preferred polyisocyanate crosslinking agent is the reaction product of trimethylol propane and 2,4-tolylene diisocyanate sold by Mobay under the tradename Mondur CB 75.

Further, hydrophilic binders can be hardened using any of a variety of means known to one skilled in the art. Useful hardening agents include aldehyde compounds such as formaldehyde, ketone compounds, isocyanates, aziridine compounds, epoxy compounds, chrome alum, zirconium sulfate, and the like.

Examples of suitable solvents for coating the magnetic recording layer include: water; ketones, such as acetone, methyl ethyl ketone, methylisobutyl ketone, and cyclohexanone; alcohols, such as methanol, ethanol, isopropanol, and butanol; esters such as ethyl acetate and butyl acetate, ethers; aromatic solvents, such as toluene; and chlorinated hydrocarbons, such as carbon tetrachloride, chloroform, dichloromethane; trichloromethane, trichloroethane, tetrahydrofuran; glycol ethers such as ethylene glycol monomethyl ether, and propylene glycol monomethyl ether; and ketoesters, such as methylacetoacetate. Optionally, due to the requirements of binder solubility, magnetic dispersability and coating rheology, a mixture of solvents may be advantageous. One preferred solvent mixture consists of a chlorinated hydrocarbon, ketone and/or alcohol, and ketoesters. Another preferred solvent mixture consists of a chlorinated hydrocarbon, ketone and/or alcohols, and a glycol ether. Other preferred solvent mixtures include dichloromethane, acetone and/or methanol, methylacetoacetate; dichloromethane, acetone and/or methanol, propylene glycol monomethyl ether; and methylethyl ketone, cyclohexanone and/or toluene. For hydrophilic binders and water-soluble binders, such as gelatin, water is the preferred solvent.

As indicated hereinabove, the magnetic recording layer also can contain additional optional components such as dispersing agents, wetting agents, surfactants or fluorinated surfactants, coating aids, viscosity modifiers, soluble and/or solid particle dyes, antifoggants, matte particles, lubricants, abrasive particles, filler particles, antistatic agents, and other addenda that are well known in the photographic and magnetic recording arts.

The transparent magnetic recording layer can be positioned in an imaging element in any of various positions. For example, it can overlie one or more image-forming layers, or underlie one or more image forming layers, or be interposed between image-forming layers, or serve as a subbing layer for an image-forming layer, or be coated on the side of the support opposite to an image-forming layer. In a silver halide photographic element, the transparent magnetic layer is preferably on the side of the support opposite the silver halide emulsion.

Conductive layers of this invention can be incorporated into multilayer imaging elements in any of various configurations depending upon the requirements of the specific imaging element. Preferably, the conductive layer of this invention is present as a subbing or tie layer underlying the magnetic recording layer on the side of the support opposite the imaging layer(s). However, conductive layers of this invention also can be overcoated with layers other than a transparent magnetic recording layer (e.g., abrasion-resistant backing layer, curl control layer, pelloid, etc.) in order to minimize the increase in the resistivity of the conductive layer after overcoating. Further, additional conductive layers also can be provided on the same side of the support as the imaging layer(s) or on both sides of the support. An optional conductive subbing layer can be applied either underlying or overlying a gelatin subbing layer containing an antihalation dye or pigment. Alternatively, both antihalation and antistatic functions can be combined in a single layer containing conductive particles, antihalation dye, and a binder. Such a hybrid layer is typically coated on the same side of the support as the sensitized emulsion layer. Additional optional layers can be present as well. An additional conductive layer can be used as an outermost layer of an imaging element, for example, as a protective layer overlying an image-forming layer. When a conductive layer is applied over a sensitized emulsion layer, it is not necessary to apply any intermediate layers such as barrier or adhesion-promoting layers between the conductive overcoat layer and the imaging layer(s), although they can optionally be present. Other addenda, such as polymer lattices to improve dimensional stability, hardeners or cross-linking agents, surfactants, matting agents, lubricants, and various other well-known additives can be present in any or all of the above mentioned layers.

Conductive layers of this invention underlying a transparent magnetic recording layer typically exhibit an internal resistivity of less than $1\times10^{10}$ ohms/square, preferably less than $1\times10^{9}$ ohms/square, and more preferably, less than $1\times10^{8}$ ohms/square.

The imaging elements of this invention can be of many different types depending on the particular use for which they are intended. Such imaging elements include, for example, photographic, thermographic, electrothermographic, photothermographic, dielectric recording, dye migration, laser dye-ablation, thermal dye transfer, electrostatographic, electrophotographic imaging elements, and others described hereinabove. Suitable photosensitive image-forming layers are those which provide color or black and white images. Such photosensitive layers can be image-forming layers containing silver halides such as silver chloride, silver bromide, silver bromoiodide, silver chlorobromide and the like. Both negative and reversal silver halide elements are contemplated. For reversal films, the emulsion layers described in U.S. Pat. No. 5,236,817, especially Examples 16 and 21, are particularly suitable. Any of the known silver halide emulsion layers, such as those described in *Research Disclosure*, Vol. 176, Item 17643 (December, 1978), *Research Disclosure*, Vol. 225, Item 22534 (January, 1983), *Research Disclosure*, Item 36544 (September, 1994), and *Research Disclosure*, Item 37038 (February, 1995) and the references cited therein are useful in preparing photographic elements in accordance with this invention.

In a particularly preferred embodiment, imaging elements including the electrically-conductive layers of this invention are photographic elements which can differ widely in structure and composition. For example, said photographic elements can vary greatly with regard to the type of support, the number and composition of the image-forming layers, and the number and types of auxiliary layers that are included in the elements. In particular, photographic elements can be still films, motion picture films, x-ray films, graphic arts films, paper prints or microfiche. It is also specifically contemplated to use the conductive layer of the present invention in small format films as described in *Research Disclosure*, Item 36230 (June 1994). Photographic elements can be either simple black-and-white or monochrome elements or multilayer and/or multicolor elements adapted for use in a negative-positive process or a reversal process. Generally, the photographic element is prepared by coating one side of the film support with one or more layers comprising a dispersion of silver halide crystals in an aqueous solution of gelatin and optionally one or more subbing layers. The coating process can be carried out on a continuously operating coating machine wherein a single layer or a plurality of layers are applied to the support. For multicolor elements, layers can be coated simultaneously on the composite film support as described in U.S. Pat. Nos. 2,761,791 and 3,508,947. Additional useful coating and drying procedures are described in *Research Disclosure*, Vol. 176, Item 17643 (December, 1978).

Imaging elements incorporating conductive layers in combination with a transparent magnetic recording layer in accordance with this invention also can contain additional layers including adhesion-promoting layers, lubricant or transport-controlling layers, hydrophobic barrier layers, antihalation layers, abrasion and scratch protection layers, and other special function layers. Imaging elements in accordance with this invention incorporating a conductive layer in combination with a transparent magnetic recording layer useful for specific imaging applications such as color negative films, color reversal films, black-and-white films, color and black-and-white papers, electrographic media, dielectric recording media, thermally processable imaging elements, thermal dye transfer recording media, laser ablation media, and other imaging applications should be readily apparent to those skilled in photographic and other imaging arts.

The present invention is illustrated by the following detailed examples of its practice. However, the scope of this invention is by no means restricted to these illustrative examples.

EXAMPLES 1–4

Aqueous antistatic coating formulations containing granular antimony-doped tin oxide conductive particles with an average primary particle size of 0.015 to 0.030 $\mu$m (by BET), acicular antimony-doped tin oxide conductive particles with mean dimensions of 0.010 $\mu$m in cross-sectional diameter and about 0.100 $\mu$m in length (by TEM), aqueous dispersed polyurethane binder, and various other additives described below were prepared at nominally 3.0% total solids by weight. The weight ratios of granular tin oxide to acicular tin oxide to polyurethane binder were nominally 25:25:50, 50:20:30, 40:20:40, and 10:30:60 for the conductive layers of Examples 1, 2, 3, and 4, respectively. These ratios expressed in terms of volume percentages are given in Table 1. The coating formulations are given below:

| Component | Weight % (wet) | | | |
|---|---|---|---|---|
| | Ex. 1 | Ex. 2 | Ex. 3 | Ex. 4 |
| Granular tin oxide[1] | 0.754 | 1.465 | 1.189 | 0.306 |
| Acicular tin oxide[2] | 0.754 | 0.587 | 0.594 | 0.918 |
| Polyurethane[3] | 1.508 | 0.879 | 1.189 | 1.837 |
| Wetting aid[4] | 0.033 | 0.033 | 0.033 | 0.033 |
| Deionized water | 96.922 | 97.037 | 96.906 | 96.906 |

[1]SN-100D, Ishihara Techno Corp.
[2]FS-10D, Ishihara Techno Corp.
[3]Witcobond W-236, Witco Corp.
[4]Triton X-100, Rohm & Haas The above coating formulations were applied to a moving web of 4 mil (100 $\mu$m) thick poly(ethylene terephthalate) film support using a coating hopper so as to provide nominal total dry coverages of 1 g/m$^2$ (Examples 1a, 2a, 3a, 4a), 0.6 g/m$^2$ (Examples 1b, 2b, 3b, 4b), and 0.3 g/m$^2$ (Example 1c). The film support had been coated previously with a typical primer layer consisting of a terpolymer latex of acrylonitrile, vinylidene chloride, and acrylic acid.

Surface electrical resistivity (SER) of the conductive layers was measured at nominally 20° C. and 50% relative humidity using a two-point DC electrode method similar to that described in U.S. Pat. No. 2,801,191. For adequate antistatic performance, conductive layers with SER values of 10 log ohms/square or less are preferred.

The conductive layers of Examples 1–4 prepared hereinabove were overcoated with a transparent magnetic recording layer as described in *Research Disclosure*, Item 34390, November, 1992. The particular transparent magnetic recording layer employed contains cobalt surface-modified $\gamma$-$Fe_2O_3$ particles in a polymeric binder which optionally may be cross-linked and optionally may contain suitable abrasive particles. The polymeric binder is a blend of cellulose diacetate and cellulose triacetate. The binder was not crosslinked in the present examples. The magnetic recording layer was applied so as to provide a nominal total dry coverage of 1.5 g/m$^2$. An optional lubricant-containing topcoat layer of carnauba wax and a fluorinated surfactant as a wetting aid may be applied over the transparent magnetic recording layer to provide a nominal dry coverage of about 0.02 g/m$^2$. The resultant multilayer structure composed of an electrically-conductive antistatic layer overcoated with a transparent magnetic recording layer, an optional lubricant layer, and other optional layers is referred to herein as a "magnetic backing package."

The electrical performance of the magnetic backing package was evaluated by measuring the internal electrical resistivity of the conductive layer using a salt bridge wet electrode resistivity (WER) measurement technique (as described, for example, in "Resistivity Measurements on Buried Conductive Layers" by R. A. Elder, pages 251–254, 1990 *EOS/ESD Symposium Proceedings*). Typically, conductive layers with WER values greater than about 12 log ohm/square are considered to be ineffective at providing static protection for photographic imaging elements. WER values less than about 9 log ohm/square are preferred. In addition to WER values, the change in resistivity of the conductive layer after overcoating with the magnetic recording layer ($\Delta$R=WER−SER) was also determined.

The optical and ultraviolet transparency of the conductive layers prepared as described herein were evaluated. Total optical (ortho) and ultraviolet densities ($D_{min}$) were evaluated at 530 nm and 380 nm, respectively, using a X-Rite Model 361T transmission densitometer. Net or $\Delta$UV $D_{min}$ and net or $\Delta$Ortho $D_{min}$ values for the magnetic backing packages were calculated by correcting the total ultraviolet and optical $D_{min}$ values for contributions from the support and any optional primer layers.

Dry adhesion performance of the magnetic backing package was evaluated by scribing a small cross-hatched region into the coating with a razor blade. A piece of high-tack adhesive tape was placed over the scribed region and quickly removed. The relative amount of coating removed is a qualitative measure of the dry adhesion. Wet adhesion performance of the magnetic backing package was evaluated using a procedure which simulates wet processing of silver halide photographic elements. A one millimeter wide line was scribed into a sample of the backings package. The sample was then immersed in KODAK Flexicolor developer solution at 38° C. and allowed to soak for 3 minutes and 15 seconds. The test sample was removed from the heated developer solution and then immersed in another bath containing Flexicolor developer at about 25° C. A rubber pad (approximately 3.5 cm dia.) loaded with a 900 g weight was rubbed vigorously back and forth across the sample in the direction perpendicular to the scribed line. The relative amount of additional material removed is a qualitative measure of the wet adhesion of the various layers.

Descriptions of the conductive layer in the magnetic backing packages, the corresponding internal resistivity (WER) values, $\Delta$R values, net ultraviolet and optical densities ($\Delta D_{min}$) are given in Table 1. The dry adhesion performance for the magnetic backing packages of Examples 1–4 was uniformly excellent. The wet adhesion performance ranged from good to excellent.

COMPARATIVE EXAMPLES 1–4

Aqueous antistatic coating formulations containing granular antimony-doped tin oxide colloidal particles with an average equivalent circular diameter of the primary particles of approximately 0.010 $\mu$m (by TEM), aqueous dispersed polyurethane binder, and a wetting aid described below were prepared at nominally 3.0% total solids by weight. The weight ratios of granular tin oxide to polyurethane binder were nominally 50:50, 70:30, 60:40, and 40:60 for the conductive layers of Comparative Examples 1, 2, 3, and 4, respectively. These ratios are expressed in terms of volume percentages in Table 1. The coating formulations are given below:

| Component | Weight % (wet) | | | |
|---|---|---|---|---|
| | Comp. Ex. 1 | Comp. Ex. 2 | Comp. Ex. 3 | Comp. Ex. 4 |
| Granular tin oxide[1] | 1.506 | 2.050 | 1.781 | 1.223 |
| Polyurethane[2] | 1.506 | 0.878 | 1.187 | 1.834 |
| Wetting aid[3] | 0.033 | 0.033 | 0.033 | 0.033 |
| Deionized water | 96.956 | 97.039 | 96.998 | 96.910 |

[1]SN-100D, Ishihara Techno Corp.
[2]Witcobond W-236, Witco Corp.
[3]Triton X-100, Rohm & Haas The above coating formulations were applied to a moving web of 4 mil (100 $\mu$m) thick poly(ethylene terephthalate) film support using a coating hopper so as to provide nominal total dry coverages of 1 g/m$^2$ (Comparative Examples 1a, 2a, 3a, 4a), 0.6 g/m$^2$ (Comparative Examples 1b, 2b, 3b, 4b), and 0.3 g/m$^2$ (Comparative Example 1c). The film support had been coated previously with a typical primer layer consisting of a terpolymer latex of acrylonitrile, vinylidene chloride, and acrylic acid.

COMPARATIVE EXAMPLES 5–8

Aqueous antistatic coating formulations containing acicular antimony-doped tin oxide particles with mean dimensions of 0.010 $\mu$m in cross-sectional diameter and about 0.100 $\mu$m in length (by TEM), aqueous dispersed polyurethane binder, and a wetting aid described below were prepared at nominally 3.0% total solids by weight. The weight ratios of acicular tin oxide to polyurethane binder were nominally 70:30, 60:40, 50:50, and 40:60 for the conductive layers of Comparative Examples 5, 6, 7, and 8, respectively. These ratios are expressed in terms of volume percentaages in Table 1. The coating formulations are given below:

| | Weight % (wet) | | | |
|---|---|---|---|---|
| Component | Comp. Ex. 5 | Comp. Ex. 6 | Comp. Ex. 7 | Comp. Ex. 8 |
| Acicular tin oxide[1] | 1.506 | 2.050 | 1.781 | 1.223 |
| Polyurethane[2] | 1.506 | 0.878 | 1.187 | 1.834 |
| Wetting aid[3] | 0.033 | 0.033 | 0.033 | 0.033 |
| Deionized water | 96.955 | 97.039 | 96.999 | 96.910 |

[1]FS-10D, Ishihara Techno Corp.
[2]Witcobond W-236, Witco Corp.
[3]Triton X-100, Rohm & Haas The above coating formulations were applied to a moving web of 4 mil (100 $\mu$m) thick poly(ethylene terephthalate) film support using a coating hopper so as to provide nominal total dry coverages of 1 g/m$^2$ (Comparative Examples 5a, 6a, 7a, 8a), 0.6 g/m2 (Comparative Examples 5b, 6b, 7b, 8b), 0.3 g/m$^2$ (Comparative Example 5c). The film support had been coated previously with a typical primer layer consisting of a terpolymer latex of acrylonitrile, vinylidene chloride, and acrylic acid.

COMPARATIVE EXAMPLE 9

Aqueous antistatic coating formulations containing acicular conductive antimony-doped tin oxide particles with mean dimensions of 0.010 $\mu$m in cross-sectional diameter and about 0.100 $\mu$m in length (by TEM), non-conductive tin oxide particles with an average primary particle size of about 0.015 $\mu$m, aqueous dispersed polyurethane binder, and various other additives described below were prepared at nominally 3.0% total solids by weight. The weight ratio of non-conductive tin oxide to acicular tin oxide to polyurethane binder was nominally 40:20:40. This ratios corresponds to a volume ratio of 14:7:79. The coating formulation is given below:

| Component | Weight % (wet) |
|---|---|
| Non-conductive tin oxide[1] | 1.189 |
| Acicular tin oxide[2] | 0.594 |
| Polyurethane[3] | 1.189 |
| Wetting aid[4] | 0.033 |
| Deionized water | 96.995 |

[1]SN-15, PQ Corporation, Nyacol Products
[2]FS-10D, Ishihara Techno Corp.
[3]Witcobond W-236, Witco Corp.
[4]Triton X-100, Rohm & Haas The above coating formulation was applied to a moving web of 4 mil (100 $\mu$m) thick poly(ethylene terephthalate) film support using a coating hopper so as to provide nominal total dry coverage of 1 and 0.6 g/m$^2$ for Comparative Examples 9a and 9b, respectively. The film support had been coated previously with a typical primer layer composed of a terpolymer latex of acrylonitrile, vinylidene chloride, and acrylic acid.

The conductive layers of Comparative Examples 1–9 prepared hereinabove were overcoated with a transparent magnetic recording layer as described in *Research Disclosure*, Item 34390, November, 1992. The particular transparent magnetic recording layer employed contains cobalt surface-modified $\gamma$-$Fe_2O_3$ particles in a polymeric binder which optionally may be cross-linked and optionally may contain suitable abrasive particles. The polymeric binder consists of a blend of cellulose diacetate and cellulose triacetate. The binder was not crosslinked in the present examples. The magnetic recording layer was applied so as to provide a nominal total dry coverage of 1.5 g/m$^2$. An optional lubricant-containing topcoat layer including carnauba wax and a fluorinated surfactant as a wetting aid may be applied over the transparent magnetic recording layer to provide a nominal dry coverage of about 0.02 g/m$^2$. The resulting magnetic backing packages were evaluated for internal resistivity (WER), $\Delta$R, and net optical and ultraviolet densities ($\Delta D_{min}$) and the results given in Table 1. The dry adhesion performance for the magnetic backing packages of Comparative Examples 1–9 also was excellent. The wet adhesion performance for magnetic backing packages of comparative Examples 1–9 ranged from fair to excellent.

TABLE 1

| | Conductive layers overcoated with transparent magnetic recording layers | | | | | | | | | |
|---|---|---|---|---|---|---|---|---|---|---|
| Sample | % GTO[1] weight | % GTO[1] volume | % ATO[2] weight | % ATO[2] volume | Total Dry Coverage[3] | SER[4] @ 50% RH | WER[4] | $\Delta$R[4] | $\Delta$ UV $D_{min}$ | $\Delta$ Ortho $D_{min}$ |
| Ex. 1a | 25 | 7.5 | 25 | 7.5 | 1 | 8.3 | 8.5 | 0.2 | 0.190 | 0.068 |
| Ex. 1b | 25 | 7.5 | 25 | 7.5 | 0.6 | 8.3 | 8.8 | 0.5 | 0.185 | 0.068 |
| Ex. 1c | 25 | 7.5 | 25 | 7.5 | 0.3 | 9.0 | 10.1 | 1.1 | 0.181 | 0.066 |
| Comp.Ex. 1a | 50 | 15 | 0 | 0 | 1 | 8.5 | 10.8 | 2.3 | 0.219 | 0.074 |
| Comp.Ex. 1b | 50 | 15 | 0 | 0 | 0.6 | 9.0 | 11.9 | 2.9 | 0.208 | 0.070 |
| Comp.Ex. 1c | 50 | 15 | 0 | 0 | 0.3 | 11.3 | >12.5 | >1.2 | 0.202 | 0.067 |

TABLE 1-continued

| Sample | % GTO[1] weight | % GTO[1] volume | % ATO[2] weight | % ATO[2] volume | Total Dry Coverage[3] | SER[4] @ 50% RH | WER[4] | ΔR[4] | Δ UV $D_{min}$ | Δ Ortho $D_{min}$ |
|---|---|---|---|---|---|---|---|---|---|---|
| Conductive layers overcoated with transparent magnetic recording layers | | | | | | | | | | |
| Comp.Ex. 5a | 0 | 0 | 50 | 15 | 1 | 7.1 | 8.8 | 1.7 | 0.195 | 0.069 |
| Comp.Ex. 5b | 0 | 0 | 50 | 15 | 0.6 | 7.2 | 9.0 | 1.8 | 0.191 | 0.067 |
| Comp.Ex. 5c | 0 | 0 | 50 | 15 | 0.3 | 7.7 | 10.2 | 2.5 | 0.187 | 0.067 |
| Ex. 2a | 50 | 20.5 | 20 | 8 | 1 | 6.5 | 7.0 | 0.5 | 0.199 | 0.074 |
| Ex. 2b | 50 | 20.5 | 20 | 8 | 0.6 | 7.2 | 7.4 | 0.2 | 0.191 | 0.069 |
| Comp.Ex. 2a | 70 | 28.5 | 0 | 0 | 1 | 6.7 | 7.0 | 0.3 | 0.218 | 0.075 |
| Comp.Ex. 2b | 70 | 28.5 | 0 | 0 | 0.6 | 7.0 | 7.6 | 0.6 | 0.209 | 0.072 |
| Comp.Ex. 6a | 0 | 0 | 70 | 28.5 | 1 | 6.3 | 7.1 | 0.8 | 0.195 | 0.068 |
| Comp.Ex. 6b | 0 | 0 | 70 | 28.5 | 0.6 | 6.4 | 7.4 | 1.0 | 0.191 | 0.067 |
| Ex. 3a | 40 | 14 | 20 | 7 | 1 | 7.1 | 7.9 | 0.8 | 0.213 | 0.079 |
| Ex. 3b | 40 | 14 | 20 | 7 | 0.6 | 7.5 | 8.2 | 0.7 | 0.198 | 0.071 |
| Comp.Ex. 3a | 60 | 21 | 0 | 0 | 1 | 7.5 | 8.1 | 0.6 | 0.217 | 0.072 |
| Comp.Ex. 3b | 60 | 21 | 0 | 0 | 0.6 | 8.0 | 8.7 | 0.7 | 0.210 | 0.070 |
| Comp.Ex. 7a | 0 | 0 | 60 | 21 | 1 | 6.6 | 7.9 | 1.3 | 0.196 | 0.069 |
| Comp.Ex. 7b | 0 | 0 | 60 | 21 | 0.6 | 6.8 | 8.2 | 1.4 | 0.191 | 0.067 |
| Comp.Ex 9a | 40 | 14 | 20 | 7 | 1 | 9.1 | >12.5 | >3 | 0.182 | 0.066 |
| Comp.Ex.9b | 40 | 14 | 20 | 7 | 0.6 | 9.4 | >12.5 | >3 | 0.180 | 0.065 |
| Ex. 4a | 10 | 2.5 | 30 | 8 | 1 | 8.2 | 10.4 | 2.2 | 0.192 | 0.067 |
| Ex. 4b | 10 | 2.5 | 30 | 8 | 0.6 | 8.6 | 10.5 | 1.9 | 0.187 | 0.064 |
| Comp.Ex. 4a | 40 | 10.5 | 0 | 0 | 1 | NC[5] | — | — | 0.204 | 0.067 |
| Comp.Ex. 4b | 40 | 10.5 | 0 | 0 | 0.6 | NC[5] | — | — | 0.199 | 0.067 |
| Comp.Ex. 8a | 0 | 0 | 40 | 10.5 | 1 | 7.5 | 10.1 | 2.6 | 0.197 | 0.068 |
| Comp.Ex. 8b | 0 | 0 | 40 | 10.5 | 0.6 | 7.7 | 10.3 | 2.6 | 0.193 | 0.067 |

[1]GTO = granular tin oxide: either undoped tin oxide (SN-15) or antimony-doped tin oxide (SN-100D)
[2]ATO = acicular antimony-doped tin oxide (FS-10D)
[3]Total Dry Weight Coverage units = $g/m^2$
[4]SER, WER, AR units = log ohms/square
[5]NC = non-conductive (SER > 13.5 log ohms/square)

The above Examples demonstrate that the conductive layers of this invention containing acicular conductive particles partially substituted for granular conductive particles exhibit smaller increases in resistivity (ΔR) and comparable WER values when overcoated with a magnetic recording layer than conductive layers containing acicular particles in the absence of granular conductive particles for the same total volume concentrations and dry weight coverages of conductive particles. Further, the conductive layers of this invention can exhibit substantially smaller increases in resistivity and thus, lower WER values after overcoating than conductive layers of prior art containing the same total volume concentrations and dry weight coverages of granular conductive particles in the absence of acicular conductive particles. For example, the conductive layers of Examples 1a, 1b and 1c containing 7.5 volume percent each of acicular and granular conductive tin oxide particles, have SER values of 8.3, 8.3, and 9.0 log ohms/square respectively prior to overcoating with a magnetic recording layer. These same layers exhibit increases in resistivity (ΔR) of 0.2, 0.5, and 1.1 log ohms/square respectively, after overcoating with the magnetic recording layer to give WER values of 8.5, 8.8, and 10.1 log ohms/square, respectively. The conductive layers of Comparative Examples 1a, 1b and 1c containing 15% by volume granular tin oxide particles and no acicular tin oxide particles have SER values of 8.5, 9.0, and 11.3 log ohms/square, respectively. These conductive layers exhibit substantially larger ΔR values of 2.3, 2.9, and >1.2 log ohms/square, respectively to give greater WER values of 10.8, 11.9, and >12.5 log ohms/square, respectively. Although the conductive layers of Comparative Examples 5a, 5b and 5c containing 15 volume percent acicular tin oxide particles have lower SER values of 7.1, 7.2, and 7.7 log ohms/square, respectively prior to overcoating than those for the corresponding conductive layers of Examples 1a, 1b and 1c, the ΔR values of 1.7, 1.8, and 2.5 log ohms/square for the former conductive layers are substantially greater, resulting in WER values of 8.8, 9.0, and 10.2 log ohms/square, respectively. However, ΔR values for conductive layers containing either granular or acicular conductive particles can be reduced to levels similar to those for the conductive layers of this invention only at higher total volume concentrations of conductive particles. For example, the conductive layer of Example 2a containing 20.5 volume percent granular conductive tin oxide particles and 8 volume percent acicular conductive tin oxide particles has a ΔR value of 0.5 log ohm/square compared to ΔR values of 0.3 log ohm/square and 0.8 log ohm/square for the conductive layers of Comparative Example 2a containing 28.5 volume percent granular conductive tin oxide particles and Comparative Example 6a containing 28.5 volume percent acicular conductive tin oxide particles, respectively. However, such high total volume concentrations of conductive particles can produce undesirably high ΔUV $D_{min}$ values. At very low total volume concentrations of conductive particles, the SER, ΔR, and WER values for conductive layers of this invention are comparable to those of conductive layers containing similar volume concentrations of acicular conductive particles. For example, the conductive layer of Example 4a, containing only 2.5 volume percent granular tin oxide particles and 8 volume percent acicular tin oxide particles has an SER value of 8.2 log ohms/square, a ΔR value of 2.2 log ohms/square, and a WER value of 10.4 log ohms/square compared with the conductive layer of Comparative Example 4a containing 10.5 volume percent acicular tin oxide particles having an SER value of 7.5 log ohm/square, a ΔR value of 2.6 log ohms/square, and a WER value of 10.1 log ohms/square. The layer of Comparative Example 8a containing 10.5 volume percent granular tin oxide particles and no acicular conductive particles is not conductive. Thus, one key advantage provided by the conductive layers of the present invention is a minimization of the increase in resistivity resulting from superposing a magnetic recording layer or other type of layer on the conductive layer compared with the increases observed for prior art conductive layers containing either granular or acicular conductive particles but not both.

A further advantage provided by the conductive layers of this invention is that the ΔUV $D_{min}$ values of the magnetic backing packages are typically less than those containing conductive layers having comparable volume concentrations of granular conductive particles and no acicular conductive particles. For example, the ΔUV $D_{min}$ values for the magnetic backing packages of Examples 3a, 3b, and 3c are substantially lower than those for the corresponding magnetic backing packages of Comparative Examples 7a, 7b, and 7c containing conductive layers having granular tin oxide particles and no acicular conductive particles. Further, the ΔUV $D_{min}$ values for the magnetic backing packages containing conductive layers of this invention are either comparable or less than those for magnetic backing packages of prior art containing conductive layers having acicular conductive tin oxide particles and no granular tin oxide conductive particles. For example, the ΔUV $D_{min}$ values for the magnetic backing packages of Examples 3a, 3b, and 3c are comparable to those for the magnetic backing packages of Comparative Examples 7a, 7b, and 7c, respectively. Further, the ΔUV $D_{min}$ values for the magnetic backing packages of Examples 4a and 4b are somewhat less than those for the magnetic backing packages of Comparative Examples 8a and 8b, respectively. Although the magnetic backing packages of Comparative Examples 9a and 9b with conductive layers containing 7 volume percent acicular conductive tin oxide particles and 14 volume percent non-conductive tin oxide granular particles have substantially lower ΔUV $D_{min}$ values than the corresponding magnetic backing packages of Examples 3a–b containing conductive tin oxide granular particles, the layers are not conductive after overcoating with the magnetic recording layer.

Thus, from the results shown in Table 1, the advantages provided by incorporating a mixture of acicular and granular conductive particles in a conductive layer onto which a magnetic recording layer or other type of overlying layer is superposed in accordance with the present invention compared with conductive layers of the prior art containing either granular or acicular conductive particles are clearly demonstrated.

While there has been shown and described what are presently considered to be the preferred embodiments of the invention, various modifications and alterations will be obvious to those skilled in the art. All such modifications and alterations are intended to fall within the scope of the appended claims.

What is claimed is:

1. An imaging element comprising:

a support;

at least one image-forming layer superposed on the support;

at least one transparent electrically-conductive layer comprising electrically-conductive granular metal-containing colloidal particles having an average particle diameter of less than or equal to 0.05 μm and electrically-conductive acicular metal-containing particles having a cross-sectional diameter of less than or equal to 0.02 μm and an aspect ratio greater than or equal to 5:1 dispersed in a first film-forming binder superposed on the support; and a transparent magnetic recording layer comprising magnetic particles dispersed in a second film-forming binder overlying the at least one transparent electrically-conductive layer.

2. The imaging element of claim 1, wherein the electrically-conductive granular metal-containing particles comprise a volume percentage of from about 5 to 30 volume percent of the at least one electrically-conductive layer.

3. The imaging element of claim 1, wherein the at least one electrically-conductive layer has a total dry weight coverage of from about 0.02 to about 1 $g/m^2$.

4. The imaging element of claim 1, wherein the average primary particle size of the electrically-conductive, granular metal-containing particles is from 0.005 to 0.020 μm.

5. The imaging element of claim 1, wherein the electrically-conductive, granular metal-containing particles comprise a metal oxide selected from the group consisting of tin oxide, zinc oxide, titanium dioxide, alumina, indium sesquioxide, zinc antimonate, indium antimonate, molybdenum trioxide, tungsten trioxide, transition metal nitrides, metal carbides, metal silicides, metal borides, metal pnictides and vanadium pentoxide.

6. The imaging element of claim 1, wherein the electrically-conductive, acicular metal-containing particles comprise a metal oxide selected from the group consisting of tin oxide, indium sesquioxide, zinc oxide, titanium dioxide, titanium suboxide, transition metal nitrides, metal carbides, metal silicides, metal borides and titanium oxynitride.

7. The imaging element of claim 1, wherein the first film-forming binder is selected from the group consisting of gelatin, cellulose derivatives, organic solvent-soluble polymers and water-dispersible, water-insoluble polymers.

8. The imaging element of claim 1, wherein the first film-forming binder comprises polyurethane.

9. The imaging element of claim 1, wherein the first film-forming binder comprises vinylidene halide interpolymer.

10. The imaging element of claim 1, wherein said support is selected from the group consisting of poly(ethylene terephthalate) films, poly(ethylene naphthalate) films, cellulose acetate films, papers, polymer-coated papers, laminated papers, and synthetic papers.

11. The imaging element as claimed in claim 1, wherein the magnetic particles comprise cobalt surface modified γ-iron oxide particles or magnetite particles.

12. The imaging element of claim 9, wherein the cobalt surface-modified γ-iron oxide particles or magnetite particles comprise a dry weight coverage of from 10 $mg/m^2$ to 1000 $mg/m^2$.

13. The imaging element of claim 1, wherein the second film-forming binder comprises cellulose diacetate, cellulose triacetate or polyurethane.

14. A photographic film comprising:

a support;

a silver halide emulsion layer superposed on a first side of said support;

a transparent electrically-conductive layer superposed on a second side of the support comprising electrically-conductive granular metal-containing colloidal particles having an average particle diameter of less than or equal to 0.05 μm and electrically-conductive acicular metal-containing particles having a cross-sectional diameter of less than or equal to 0.02 μm and an aspect ratio greater than or equal to 5:1 dispersed in a first film-forming binder; and a transparent magnetic recording layer overlying said electrically-conductive layer comprising magnetic particles dispersed in a second film forming binder.

15. A thermally-processable imaging element comprising:

a support;

an imaging layer superposed on a first side of said support;

a transparent electrically-conductive layer superposed on a second side of the support comprising electrically-conductive granular metal-containing colloidal particles having an average particle diameter of less than or equal to 0.05 $\mu$m and electrically-conductive acicular metal-containing particles having a cross-sectional diameter of less than or equal to 0.02 $\mu$m and an aspect ratio greater than or equal to 5:1 dispersed in a first film-forming binder; and a transparent magnetic recording layer overlying said electrically-conductive layer comprising magnetic particles dispersed in a second film-forming binder.

* * * * *